United States Patent [19]

Forestier et al.

[11] Patent Number: 4,527,952

[45] Date of Patent: Jul. 9, 1985

[54] DEVICE FOR LOCKING A TURBINE ROTOR BLADE

[75] Inventors: Alexandre Forestier, Vaux le Penil; Raymond J. M. Joubert, Savigny sur Orge, both of France

[73] Assignee: S.N.E.C.M.A., Paris, France

[21] Appl. No.: 386,349

[22] Filed: Jun. 8, 1982

[30] Foreign Application Priority Data

Jun. 12, 1981 [FR] France ..... 81 11565

[51] Int. Cl.[3] ..... F01D 5/32

[52] U.S. Cl. ..... 416/220 R

[58] Field of Search ..... 416/220 R, 220 A, 219 R, 416/218, 221; 403/319, 355, 381

[56] References Cited

U.S. PATENT DOCUMENTS

| | | | |
|---|---|---|---|
| 2,843,356 | 7/1958 | Hull, Jr. | 416/220 X |
| 2,949,278 | 8/1960 | McCormick | 416/220 R |
| 3,014,695 | 12/1961 | Rankin | 416/220 R |
| 3,378,230 | 4/1968 | Toomey | 416/221 |
| 3,653,781 | 4/1972 | Cooper | 416/221 |
| 3,936,234 | 2/1976 | Tucker et al. | 416/220 R |
| 3,986,779 | 10/1976 | Beckershoff | 416/220 R UX |
| 4,405,285 | 9/1983 | Surdi | 416/220 R |

FOREIGN PATENT DOCUMENTS

| | | | |
|---|---|---|---|
| 1570396 | 6/1969 | France . | |
| 2273155 | 12/1975 | France . | |
| 2345605 | 10/1977 | France . | |
| 20896 | 2/1961 | German Democratic Rep. | 416/220 |
| 671960 | 4/1952 | United Kingdom | 416/220 |
| 1491480 | 11/1977 | United Kingdom . | |

*Primary Examiner*—Robert E. Garrett
*Assistant Examiner*—Joseph M. Pitko
*Attorney, Agent, or Firm*—Oblon, Fisher, Spivak, McClelland & Maier

[57] ABSTRACT

The rim of the rotor disk has teeth formed by axial grooves. The grooves accept the bases of the blades, which are radially locked by wedges placed between the root and the bottom of the groove. The blade base is extended by a shank bearing the platform and the blade. The locking device comprises locks provided on at least part of the sides of the spindle, and housing provided in the teeth and shaped in such a way that they interact with the locks when the wedge is placed between the blade base and the bottom of the groove. According to one embodiment, the locks are formed by the portions which extend from a locking part lodged in a notch of the blade base and of the shank.

10 Claims, 9 Drawing Figures

1
2
3
4
4
5
6
7
8
12
12
13
14
15
16
17
50
51

55
54
55
50
51
56
56
54
7

DEVICE FOR LOCKING A TURBINE ROTOR BLADE

BACKGROUND OF THE INVENTION

1. Field of the Invention:

This invention relates to a device for locking a turbine rotor blade, wherein the rim of the rotor disk is provided with teeth formed by essentially axial grooves. The grooves are designed to accept the roof of the blades which are radially locked by wedges positioned between the blade roof and the bottom of the groove. Each blade roof is extended by a shank having a platform and a blade wherein the device of the invention comprises a locking piece which interacts with corresponding housings in the axial groove.

2. Description of the Prior Art:

Axial blade locking devices are known. The known devices include a lock which interacts with housings provided in the blade roof and in the axial groove into which the blade is inserted and radially maintained. This lock is kept in place by a wedge inserted between the bottom of the groove and the underside of the blade roof.

French Pat. No. 2,345,605 discloses a device of this type. The rim of the rotor disk comprises axial, dovetailed grooves which partially extend into a peripheral portion of the rim which protrudes relative to the surface of the disk. The blade roof include a tooth which corresponds to the protruding portion of the rim and which is provided with a transverse slot across its underside. Opposed radial slots are provided in the edges of the axial grooves. The lock is in the form of a U-shaped part, the outside surfaces of the lateral arms of which interact with the radial slots in the groove, and the transverse arm of which interacts with the transverse slot in the blade roof. The U-shaped part is inserted radially from the inside toward the outside into each slot and is kept in place by the end of the wedge inserted between the blade roof and the bottom of the groove. The wedge is axially maintained in a conventional manner by flanges on the nose cone and/or on the drum of the preceding or following rotor.

This device is reliable and easily assembled and disassembled. However, its disadvantage is that it requires a blade having a tooth and a protruding rim, the consequence of which is to increase the total mass of the rotor.

French Patent No. 2,273,155 describes a device which requires neither a blade tooth nor a protruding rim. The blade roof extremities are parallel; the blade does not include a tooth and the rim which bears the axial grooves does not have a protruding peripheral part. The axial grooves are dovetailed and are transversally separated by a peripheral groove parallel to the disk surfaces. The underside of the blade base is provided with two notches, an axial notch and a transverse notch, wherein the axial notch corresponds to a similar notch provided in the bottom of the axial groove, and the transverse notch corresponds to the peripheral groove.

The lock is formed of an elastic, elongated part with the same width as that of the groove, and displays in its center a transverse part forming a cross. The lock is placed in the groove in such a way that the transverse part is aligned with the notch at the bottom of the groove. When the blade is slipped into place in the groove, the lock is partially lodged in the axial and transverse notches of the blade base, and maintains the blade in the axial direction.

This device provides for a lower total rotor mass. However, its disadvantage is that it requires special tooling for installing or removing the blades.

SUMMARY OF THE INVENTION

The present invention is designed to provide an axial blade locking device which provides for easy manipulation of the blades while retaining the lowest possible total rotor mass.

The locking device according to the invention is unique in that it comprises locks provided on at least the sides of the shank which interact with bearing surfaces provided on the teeth of the rim, when the wedge is positioned between the blade roof and the bottom of the groove.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or correspondings parts throughout the several views, and wherein.

DETAILED DESCRIPTION OF THE PREFERRED EMBODIMENTS

Figure 1:
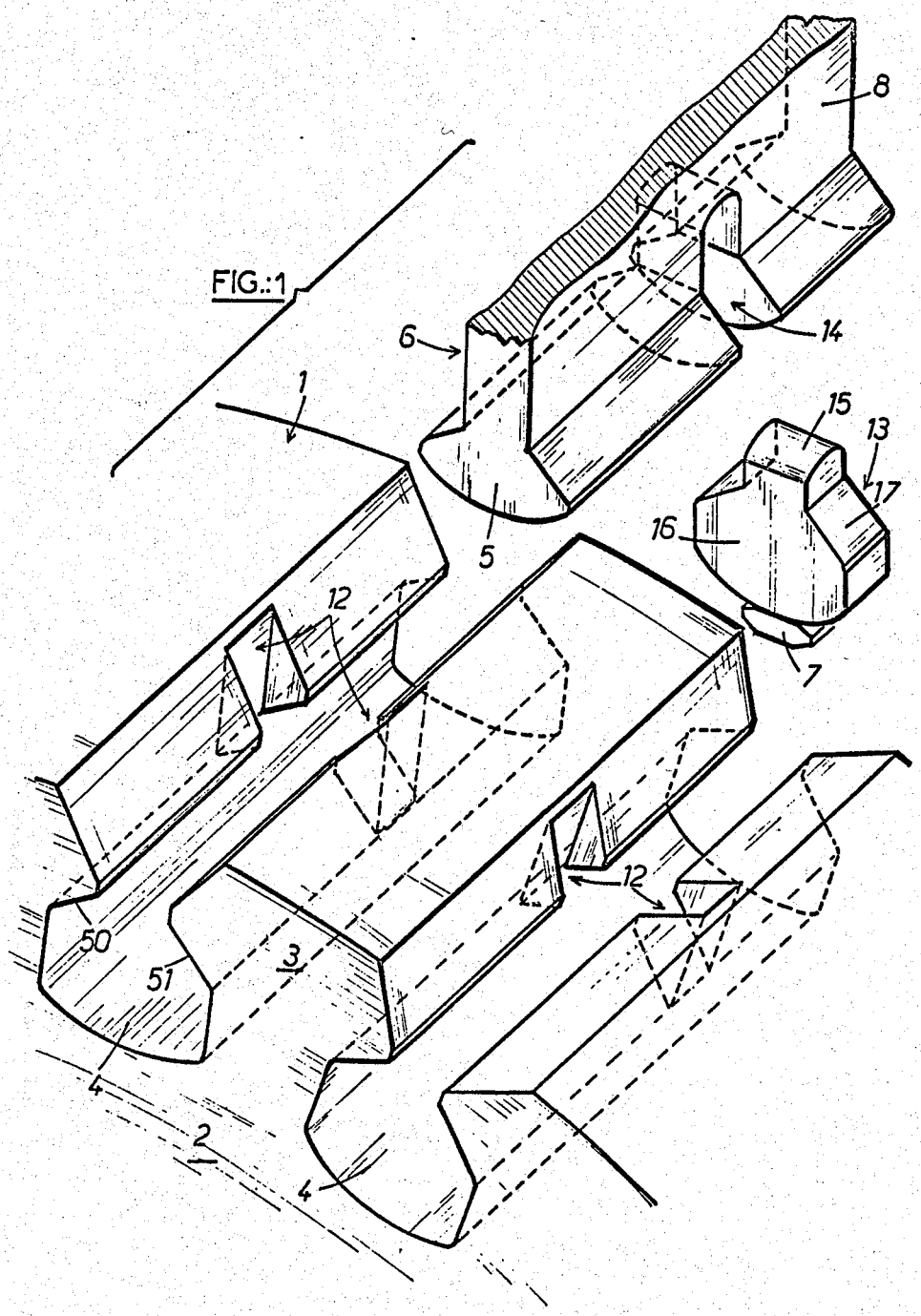
FIG. 1 is an exploded view of a locking device according to one embodiment of the invention.
Figure 2:
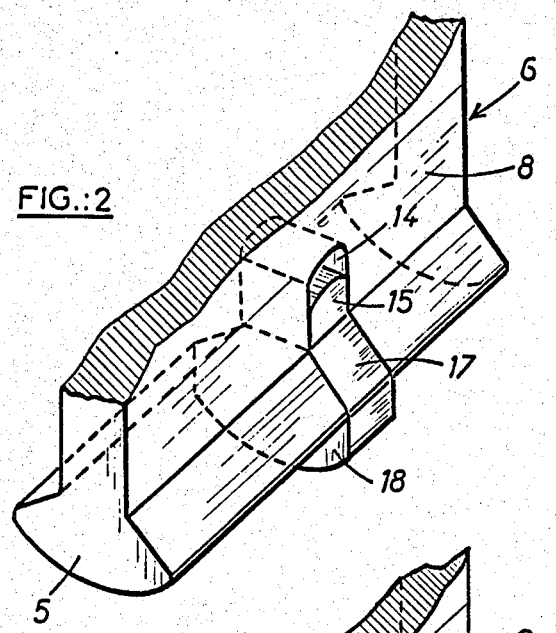
FIG. 2 shows the locking device according to the invention, wherein the locks are formed of a locking part lodged in a slot in the blade roof.

FIG. 1 is an exploded view of a part of an rotor disk and of a blade wherein a locking device according to the invention is provided.

The rim 1 of the rotor disk 2 is provided with teeth 3 formed by the axial grooves 4, which accept the roof 5 of the blades 6. The blades are locked radially by wedges 7 positioned between the underside of the blade base and the bottom of the groove.

Figure 4:
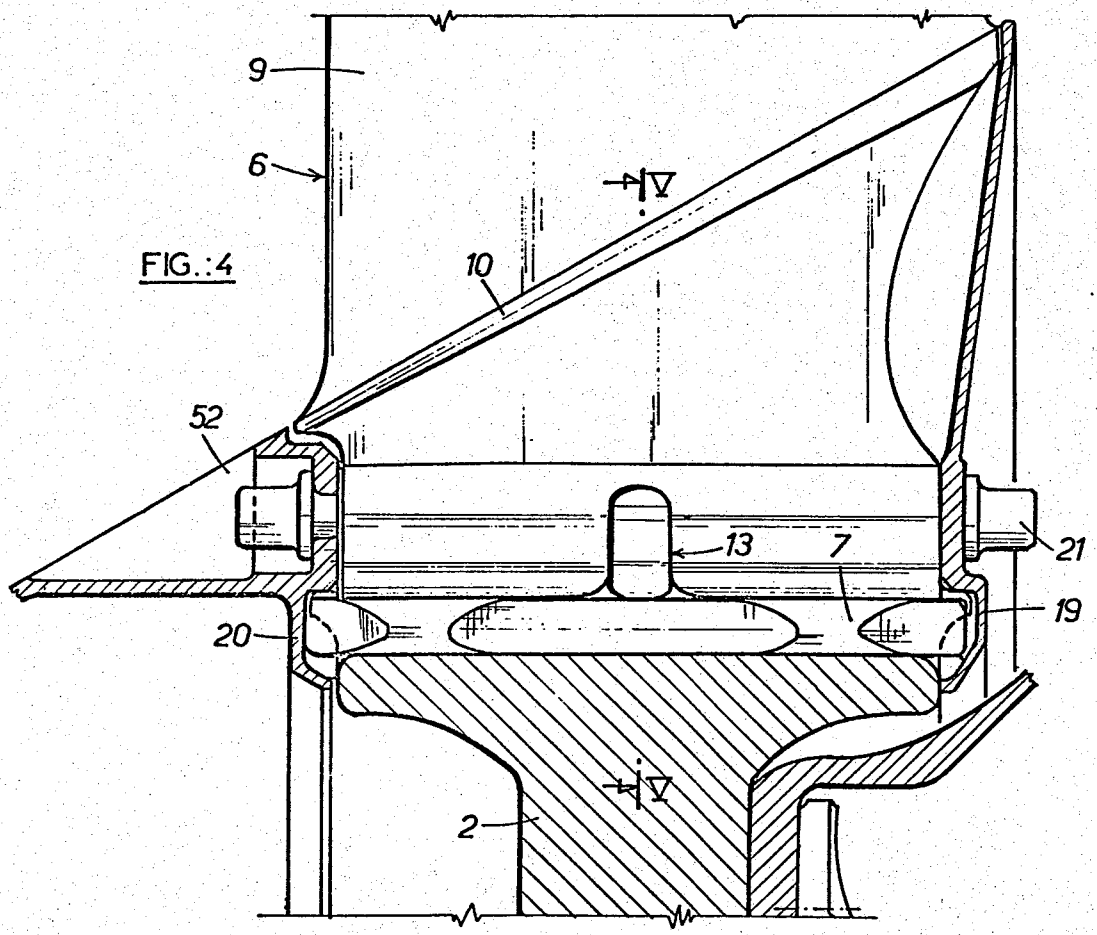
FIG. 4 is a cross-section along an axial plane of the locking device shown in FIG. 1.
Figure 5:
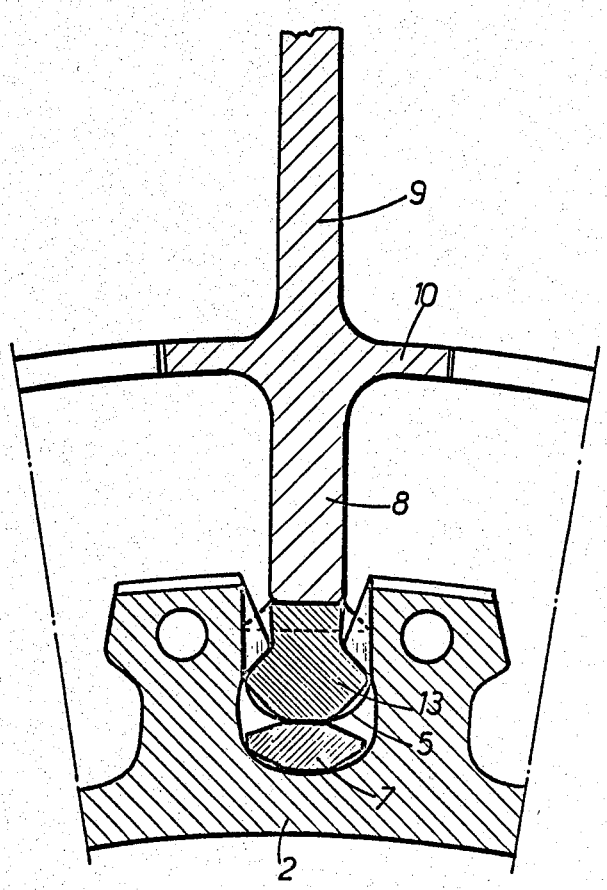
FIG. 5 is a cross-section along line V—V of FIG. 4.

FIG. 4 shows that the blade roof is extended by a spindle 8, which is separated from blade 9 by a platform 10.

According to the invention, axial locking of the blade is obtained by a device in the form of stops 11 (FIG. 3) provided on at least part of the sides of the shank 8, and housings 12 provided on the teeth 3 of the rim and shaped so that they interact with the locks 11 when the wedge 7 is positioned between the blade roof and the bottom of the groove.

According to the embodiment shown in FIGS. 1 to 5, the locks 11 are formed by a part of a locking part 13 lodged in a notch 14 in the blade roof and in the shank, said notch being located in the median radial plane of the blade, or near this plane.

The top side 15 of the locking part has an approximately parallelipipedic shape corresponding to the notch in the shank, and the underside 16 has a shape and dimensions similar to that of a vertical section of the axial groove. The thickness of these parts 15 and 16 is equal to the width of the notches in the blade base and the shank. When the locking part 13 is positioned in the notch 14 in such a way that the oblique sides 17 of the top side are flush with the oblique top sides of the blade base, a portion 18 of the locking part extends below the blade roof (see FIG. 2). The height of portion 18 is such that it does not prevent its insertion into the axial groove 4. When the locking part is in the position described above, the top of part 15 is separated from the bottom of notch 14 by a distance which is at least equal to the height of the portion 18 which extends below the blade base.

After insertion of the blade base equipped with the locking part maintained in the position described above, a wedge 7 is inserted in the axial groove 4 between the underside of the blade base and the bottom of the groove. This wedge pushes the locking part 13 into the notch 14 and into the housings 12. These housings 12 are formed of two machined notches which face each other on opposing edges of two teeth 3. Their positions and dimensions are defined as a function of the position of the notch in the blade roof and are, for example, in the median radial plane of the rotor disk.

The wedge 7 locks the blade base and the locking part 13 in a radial direction. The locking part, in turn, locks the blade in the axial direction. Wedge 7 is axially held, for instance by side plates 19 and 20 attached to the rim by bolts 21, or by any other conventional method (for instance, the method shown in FIG. 8 of the third embodiment).

Figure 3:
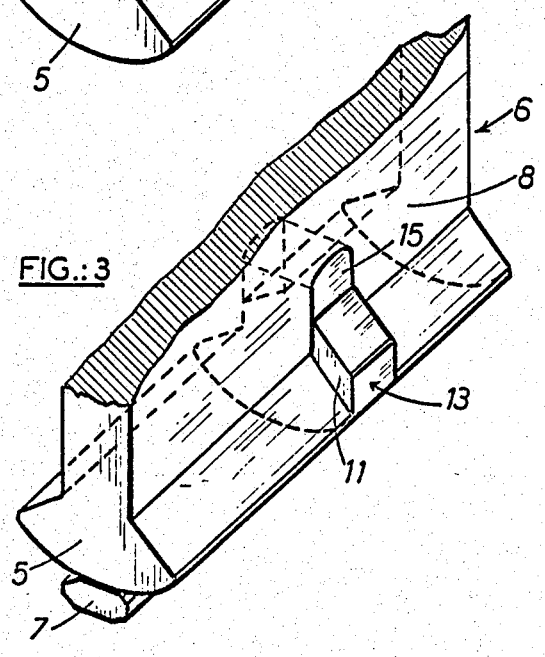
FIG. 3 shows the same locking part when maintained by the wedge.

According to another method for installing the blade roof 5 in the groove 4, the locking part 13 is held by a conventional method (gluing or brazing, for instance) in the notch in the blade base and the shank in such a way that portion 18 is level with the underside of the blade roof The blade base then appears as shown in FIG. 3. It is inserted into the axial groove in such a way that the underside of the roof slides against the bottom of the groove. The locks 11 having sides 17 slide along the edges 50 and 51 in the groove. When the blade base is fully placed in the groove, wedge 7 is inserted between the underside of the base and the bottom of the groove; the wedge radially locks the base/locking part assembly, and the locking part interacts with the housings 12 to axially lock the assembly.

Figure 6:
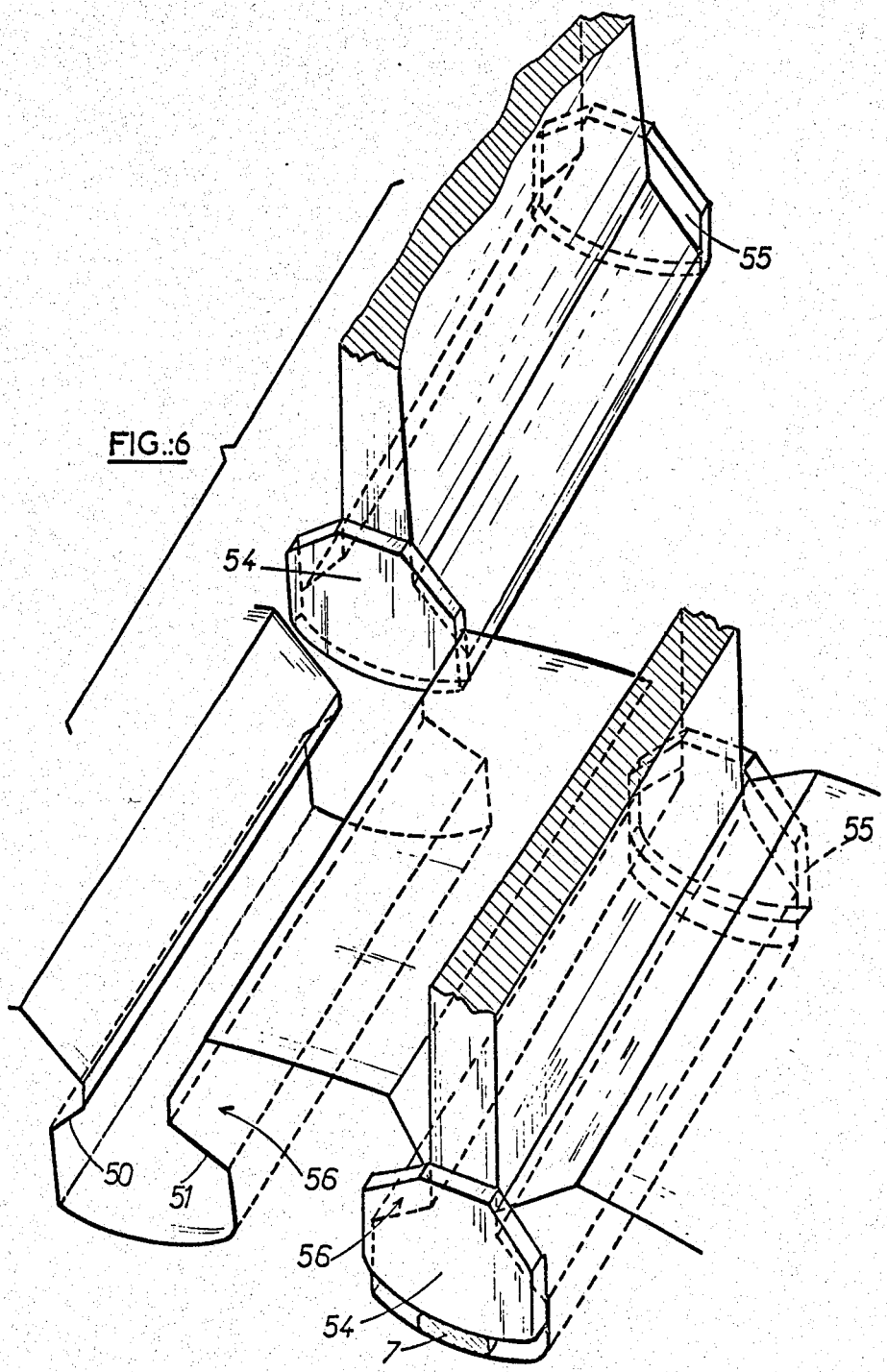
FIG. 6 is an illustration of a second embodiment of a locking device according to the invention.

According to a similar embodiment of the locking device shown in FIG. 6, the stops are an integral part of the blade base and a part of the ends of the shank are formed as end pieces 54 and 55, the shape and dimensions of which are similar to that of a vertical section of the axial grooves 4 of the disk. These pieces 54 and 55 are affixed by brazing or welding, or by any other conventional method, onto one or both ends of the blade base extended by the spindle.

Installation is performed in a manner similar to that described above; the blade base is inserted into the axial groove, then wedge 7 is slipped under the base, the effect of which is to cause the blade to "rise" radially in such a way that the oblique sides of the base come into contact with sides 50 and 51 of the groove. The top sides of the end pieces 54, 55 then "frame" the ends of the disk teeth. These top sides form stops which interact with parts 56 of the axial ends of the teeth of the rim and axially lock the blade. Wedge 7 is locked as described previously. The advantage of this configuration is that it avoids indentations in the locking system which weaken the blade and the disk.

Figure 7:
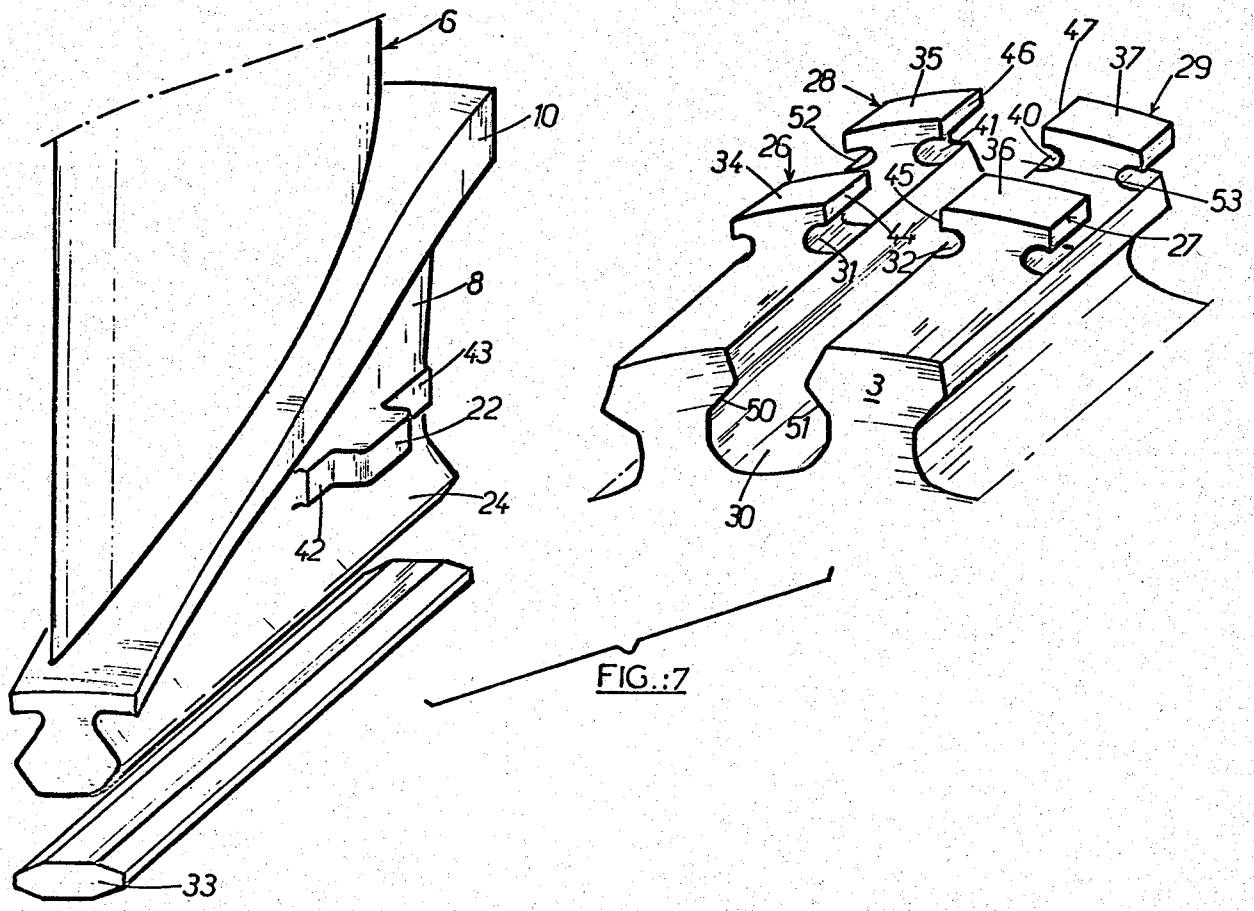
FIG. 7 is an exploded view of a third embodiment of a locking device according to the invention.
Figure 8:
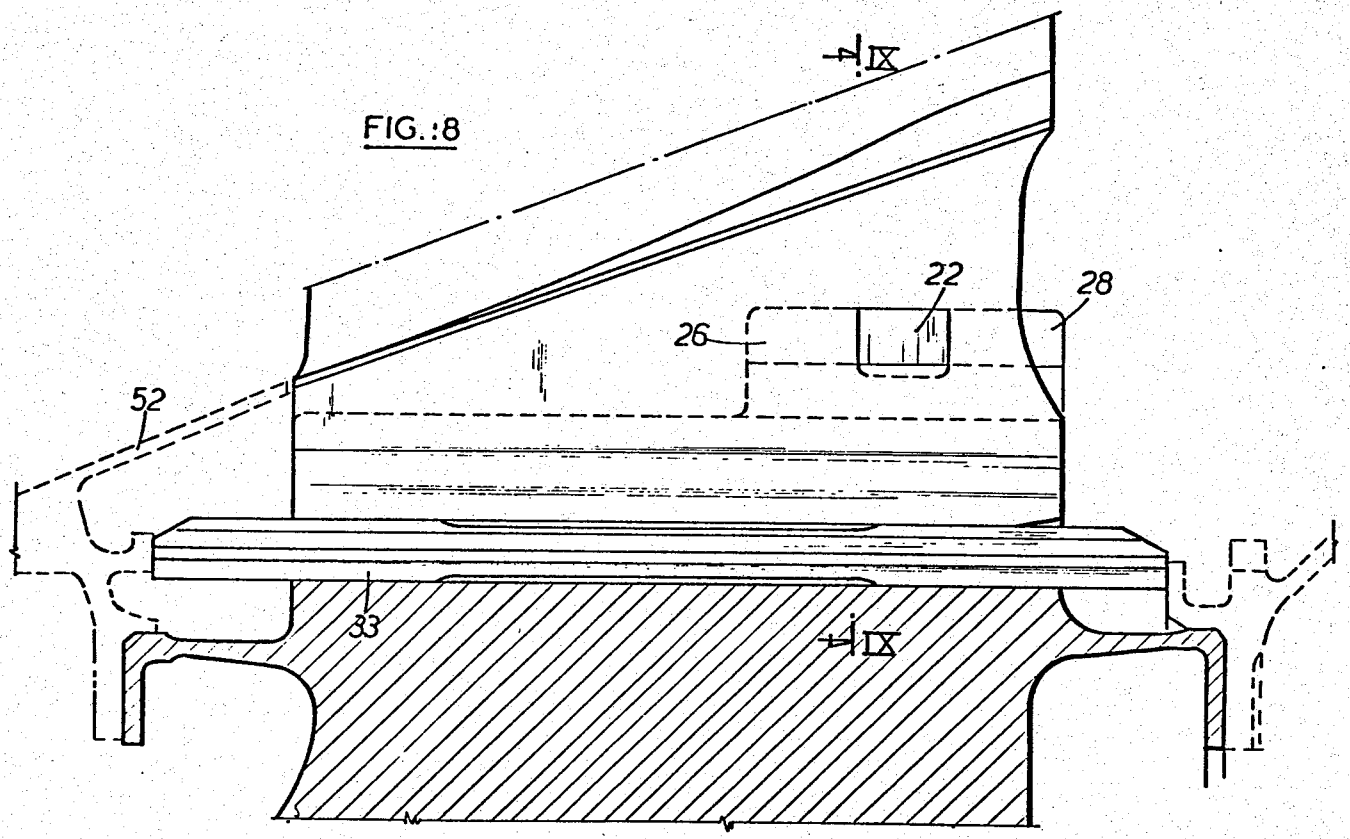
FIG. 8 is a view through an axial plane of the device as shown in FIG. 7.
Figure 9:
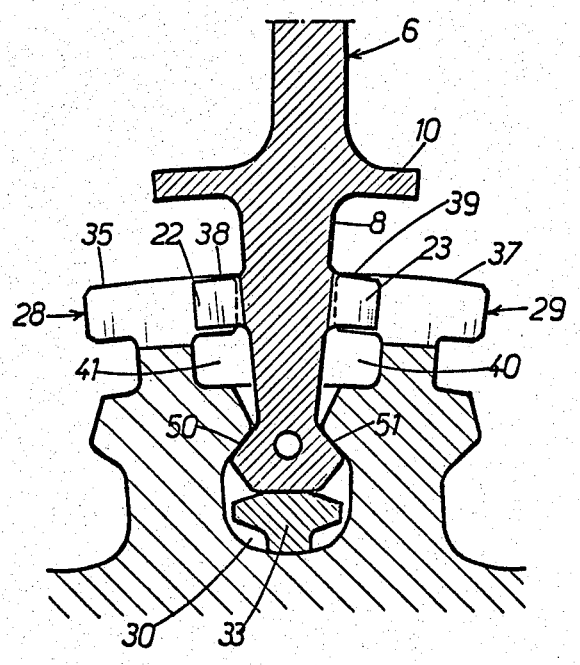
FIG. 9 is a view through line IX—IX of FIG. 8.

FIGS. 7 to 9 show another embodiment of the device according to the invention.

The locks are in the form of studs 22 and 23 which are an integral part of the shank 8 and placed at a predetermined distance from the roof 24. The housings intended to interact with the locks are formed of stop pieces 26, 27, 28 and 29 positioned in pairs on both sides of the edges of groove 30. Two stop pieces 26 and 28 versus 27 and 29, positioned on the same edge of the groove, are separated by a distance equal to the width of the studs 22 and 23. The two opposite stop pieces 26 and 27, facing each other on two teeth of the disk, and positioned closest to the end of the groove through which the blade base is inserted, have axial lateral indentations 31 and 32 on the facing sides thereof. The depth of the indentations provide for passage of the studs 22 and 23 of the shank. The height of the stop pieces is such that when the blade base is positioned in the groove 30 and radially locked by wedge 33, the studs 22 and 23 are positioned between the stop pieces 26, 28 and 27, 29 in spaces 52 and 53 which form housings, the tops 34, 35, 36 and 27 of the stop pieces being approximately in the plane of the top sides 38 and 39 of the studs.

According to the embodiment shown in FIG. 7, the blade base may be inserted through either extremity of groove 30 and, in this instance, all of the stop pieces have lateral axial indentations 31, 32, 40 and 41.

The blade base and the locking device are installed as follows: the blade base 24 is inserted into groove 30, the blade being directed as shown in FIG. 6, with the underside of the base sliding against the bottom of the groove. In this position, studs 22 and 23 pass over the edges of the teeth and between indentations 31 and 32 of the stop pieces 26 and 27. When the extremities of the blade base are level with the lateral sides of the rim, the studs are between stop pieces 26, 28 and 27, 29. Wedge 33 is inserted between the base and the bottom of the groove in such a way that the top part of the base comes to rest against sides 50 and 51 of groove 30. The blade thus moves radially and the studs come to rest between the stop pieces in such a way that the top sides of the studs are approximately in the same plane as the top sides 34, 35, 36 and 37 of the stop pieces.

As in the first embodiment, wedge 33 is axially locked, for instance by plates such as 19 and 20, shown in FIG. 1, or by any other conventional means, (for instance, as shown in FIG. 8) by pressure toward the rear on a flange which is integral with the disk drive drum and by ascending pressure on a flange on the nose cone, which is affixed by any conventional means.

In order to prevent any transverse movement of the shank, surfaces 42 and 43 frame each of the studs 22 and 23. These surfaces fit snugly between the stop pieces, and more particularly against the axial lateral sides 44, 45, 46 and 47 to prevent rattling at low speeds.

The stop pieces may extend along the entire width of the teeth and be symmetrical relative to the axial median plane of the latter. Thus, the stop pieces of one tooth, for instance 26, 28 or 27, 29 will hold the studs of two adjacent blades. The stop pieces are generally formed by machining the rim. Because of the position of the studs on the shank and of the incline of the blade platform, the stop pieces may be provided at the rear of the rim in order to facilitate blade assembly.

The various embodiments of the locking device according to the invention provide for independent locking of each blade, which provides for easy maintenance of the rotor by removing only the affected blades. According to the embodiment selected, once the nose cone 52 has been removed, only wedge 7 or 33 needs to be removed for the assembly (locking part and roof) to descend into axial groove 4 or 30 and to be removed.

Obviously, numerous modifications and variations of the present invention are possible. It is therefore to be understood that within the scope of the appended claims, the invention may be practiced otherwise than as specifically described herein.

What is claimed as new and desired to be secured by Letters Patent of the United States is:

1. A device for locking a turbine rotor blade on a rotor disk, said disk including a plurality of teeth defining axial grooves therebetween, said blade including a blade portion, a platform, a shank and further including a root adapted to fit in one axial groove, said blade being radially lockable in said groove by a wedge positionable in a first position between said blade root and a radial bottom of said groove, said device comprising:

a lock unitarily fixed to said shank, said lock having surfaces radially projecting from at least one circumferential side of said shank;

radial bearing surfaces on said teeth;

wherein said lock and bearing surfaces are dimensioned and positioned between the axial ends of the disk teeth such that each said lock interacts with one of said bearing surfaces when said wedge is in said first position, wherein said blade and said lock are constructed so as to be together shiftable in an axial direction for disengaging said locks and said bearing surfaces when said wedge has been removed from said first position.

2. The device of claim 1 including:

a transverse notch in said blade shank and roof;

a locking part positionable in said notch; and housings provided in the circumferential sides of each said axial groove, wherein at least a portion of said locking part comprises said lock wherein said locking part is fixed in said notch, and wherein said housings comprise said bearing surfaces.

3. The device of claim 2 wherein said radially projecting surfaces of said notch and said locking part approximate corresponding parallelipipeds, wherein the shape of the radially lower surface of said locking part corresponds to that of said radial bottom of said groove, and wherein the thickness of said locking part and notch are equal.

4. The device of claim 3 wherein said locking part is fixed in said notch in such a position that said radially lower surface of said locking part is aligned with the radially lower surface of said blade roof.

5. the device of claims 2 or 3 or 4 wherein said notch and said housings are respectively in the median radial planes of said blade and said disk.

6. The device of claim 1 including:

circumferentially extending studs affixed to said shank;

spaced radial protrusions on at least one circumferential edge of each groove, said protrusions being spaced by the width of said studs so as to define housings therebetween; and at least one circumferentially and axially extending indentation in each said protrusion, wherein said studs comprise said stops, said housings comprise said bearing surfaces, and wherein said studs can pass through said indentations.

7. The device of claim 6 including framing surfaces axially aligned with each of said studs, said framing surfaces contacting the circumferential sides of said radial protrusions when said wedge is in said first position.

8. The device of claims 6 or 7 including said radial protrusions on both edges of each said groove.

9. The device of claims 6 or 7 wherein said studs and radial protrusions are respectively not in the medial plane of said blade and said disk.

10. The device of claim 1, wherein said lock is fixed to said shank by being bonded thereto.

* * * * *

UNITED STATES PATENT AND TRADEMARK OFFICE

CERTIFICATE OF CORRECTION

PATENT NO. : 4,527,952

DATED : JULY 9, 1985

INVENTOR(S) : ALEXANDRE FORESTIER ET AL

It is certified that error appears in the above-identified patent and that said Letters Patent is hereby corrected as shown below:

In the Abstract, lines 4, 10 and 13, change "blade base" to --blade root--;

In the Abstract, line 7, change "spindle" to --shank--;

In Column 1, lines 20, 24, 29 and 51, change "blade roof" to --blade root--;

In Column 1, line 56, change "blade base" to --blade root--;

In Column 2, lines 1 and 55, change "blade base" to --blade root--;

In Column 2, lines 32, 56, 64 and 68, change "blade roof" to --blade root--;

In Column 2, line 48, change "an rotor disk" to --a rotor disk--;

UNITED STATES PATENT AND TRADEMARK OFFICE

CERTIFICATE OF CORRECTION

PATENT NO. : 4,527,952

DATED : JULY 9, 1985

INVENTOR(S) : ALEXANDRE FORESTIER ET AL

It is certified that error appears in the above-identified patent and that said Letters Patent is hereby corrected as shown below:

In Column 2, line 60, change "stops" to --locks--;

In Column 3, line 4, change "parallelilipedic" to --parallelepidedic--;

In Column 3, lines 8, 12, 19, 23, 31, 43, 47, 55, 60 and 63, change "blade base" to --blade root--;

In Column 3, lines 29, 39 and 42, change "blade roof" to --blade root--;

In Column 3, line 61, change "spindle" to --shank--;

In Column 4, line 11, change "roof 24" to --root 24--;

In Column 4, lines 20, 24, 32, 35 and 41, change "blade base" to --blade root--;

UNITED STATES PATENT AND TRADEMARK OFFICE

CERTIFICATE OF CORRECTION

PATENT NO. : 4,527,952

DATED : JULY 9, 1985

INVENTOR(S) : ALEXANDRE FORESTIER ET AL

It is certified that error appears in the above-identified patent and that said Letters Patent is hereby corrected as shown below:

In Column 4, line 28, change "34, 35, 36 and 27" to --34, 35, 36 and 37--;

In Column 5, line 9, change "locking part and roof" to --locking part and root--;

In Column 5, line 40, change "roof" to --root--;

In Column 6, line 7, change "parallelipideds" to --parallelepipeds--;

In Column 6, line 15, change "blade roof" to --blade root--.

Signed and Sealed this

*Fifteenth* Day of *October 1985*

[SEAL]

*Attest:*

*Attesting Officer*

DONALD J. QUIGG

*Commissioner of Patents and Trademarks—Designate*